US010875043B1

(12) United States Patent
Lin

(10) Patent No.: US 10,875,043 B1
(45) Date of Patent: Dec. 29, 2020

(54) LOTION PUMP

(71) Applicant: Po-Hui Lin, Taipei (TW)

(72) Inventor: Po-Hui Lin, Taipei (TW)

(73) Assignee: Ableman International Co., Ltd., Taipei (TW)

( * ) Notice: Subject to any disclaimer, the term of this patent is extended or adjusted under 35 U.S.C. 154(b) by 0 days.

(21) Appl. No.: 17/035,810

(22) Filed: Sep. 29, 2020

(51) Int. Cl.
*B05B 11/00* (2006.01)

(52) U.S. Cl.
CPC ..... *B05B 11/3073* (2013.01); *B05B 11/3001* (2013.01); *B05B 11/3043* (2013.01)

(58) Field of Classification Search
CPC ..... B05B 11/3073; B05B 11/3001; B05B 11/3043
See application file for complete search history.

(56) References Cited

U.S. PATENT DOCUMENTS

2005/0284887 A1* 12/2005 Lewis ..... B05B 7/0037 222/181.3
2007/0119864 A1* 5/2007 Tsai ..... B05B 11/3087 222/137
2009/0101671 A1* 4/2009 Cittadino ..... A47K 5/1202 222/23
2010/0181342 A1* 7/2010 Lin ..... A47K 5/14 222/181.3
2014/0209631 A1* 7/2014 Lin ..... A47K 5/1217 222/52

* cited by examiner

*Primary Examiner* — Jeremy Carroll

(57) ABSTRACT

A lotion pump includes an internally threaded sleeve; a spring-loaded dip tube including an annular first flange on an outer surface, and an internal shoulder; a first housing including a tapered head, a chamber spaced from the tapered head, a tunnel communicating between the tapered head and the chamber, overflow openings on the tunnel, and first external threads on an outer surface of the chamber; a check valve; a second housing including an open first chamber member, an open second chamber member, a channel communicating between the first chamber member and the second chamber member, second external threads, and an annular second flange on an outer surface; a support including an annular third flange on an outer surface, and an second opening; a spring-loaded valve; and an internally threaded cup including an annular fourth flange on an outer surface, and a second hole through a second end.

1 Claim, 21 Drawing Sheets

LOTION PUMP

BACKGROUND OF THE INVENTION

1. Field of the Invention

The invention relates to manually operated vertically reciprocated pumps and more particularly to a lotion pump having improved characteristics.

2. Description of Related Art

Conventionally, a lotion pump include a housing attached to the neck of a container containing liquid, and a manually operated plunger extending vertically downward into the housing. The housing includes a chamber disposed in container. A dip tube extends downwardly from the chamber into the liquid. A check valve is mounted between the chamber and the dip tube. The check valve controls the flow of liquid into the chamber from the dip tube, but prevents the reverse flow of liquid. A spring is disposed in the chamber.

However, the lotion pumps of this type have drawbacks including complicated design and very high precision requirements.

Thus, the need for improvement still exists.

SUMMARY OF THE INVENTION

It is therefore one object of the invention to provide a lotion pump comprising an internally threaded sleeve; a dip tube including an annular first flange on an outer surface, and an internal shoulder; a biasing member put on the dip tube to have a first end urging against the first flange; a first housing including a tapered head, a chamber spaced from the tapered head, a tunnel communicating between the tapered head and the chamber, a plurality of spaced overflow openings on the tunnel adjacent to the tapered head, and first external threads on an outer surface of the chamber; a check valve including a first opening, a first hole spaced from the first opening, and a ball disposed between the first opening and the first hole; a second housing including a first chamber member open to a first end, a second chamber member open to a second end, a channel communicating between the first chamber member and the second chamber member, second external threads on a projected portion of the second chamber member, and an annular second flange on an outer surface adjacent to the second external threads; a support including an annular third flange on an outer surface adjacent to a first end, and an second opening at a second end; a spring-loaded valve including a plug; and an internally threaded cup having an open first end and including an annular fourth flange on an outer surface, and a second hole through a second end; wherein the check valve is disposed in the tunnel, the dip tube is disposed in the tunnel of the first housing, a first end of the tunnel urges against a second end of the check valve, the first flange of the dip tube urges against the tunnel, the second housing is disposed in the support, the second flange of the second housing urges against an inner surface of the second end of the support, the second external threads of the second housing pass through the second opening of the support to threadedly fasten in the internally threaded cup, the spring-loaded valve is partially disposed in the second chamber member of the second housing with the plug of the spring-loaded valve urging against the channel of the second housing, an end of the spring-loaded valve enters the internally threaded cup to urge against the second hole of the internally threaded cup, a second end of the biasing member urges against the third flange of the support, the first end of the second housing urges against the internal shoulder of the dip tube, the internally threaded sleeve is threadedly secured to the first external threads of the first housing, and the third flange of the support is fastened in the internally threaded sleeve.

The above and other objects, features and advantages of the invention will become apparent from the following detailed description taken with the accompanying drawings.

DETAILED DESCRIPTION OF THE INVENTION

Figure 1:
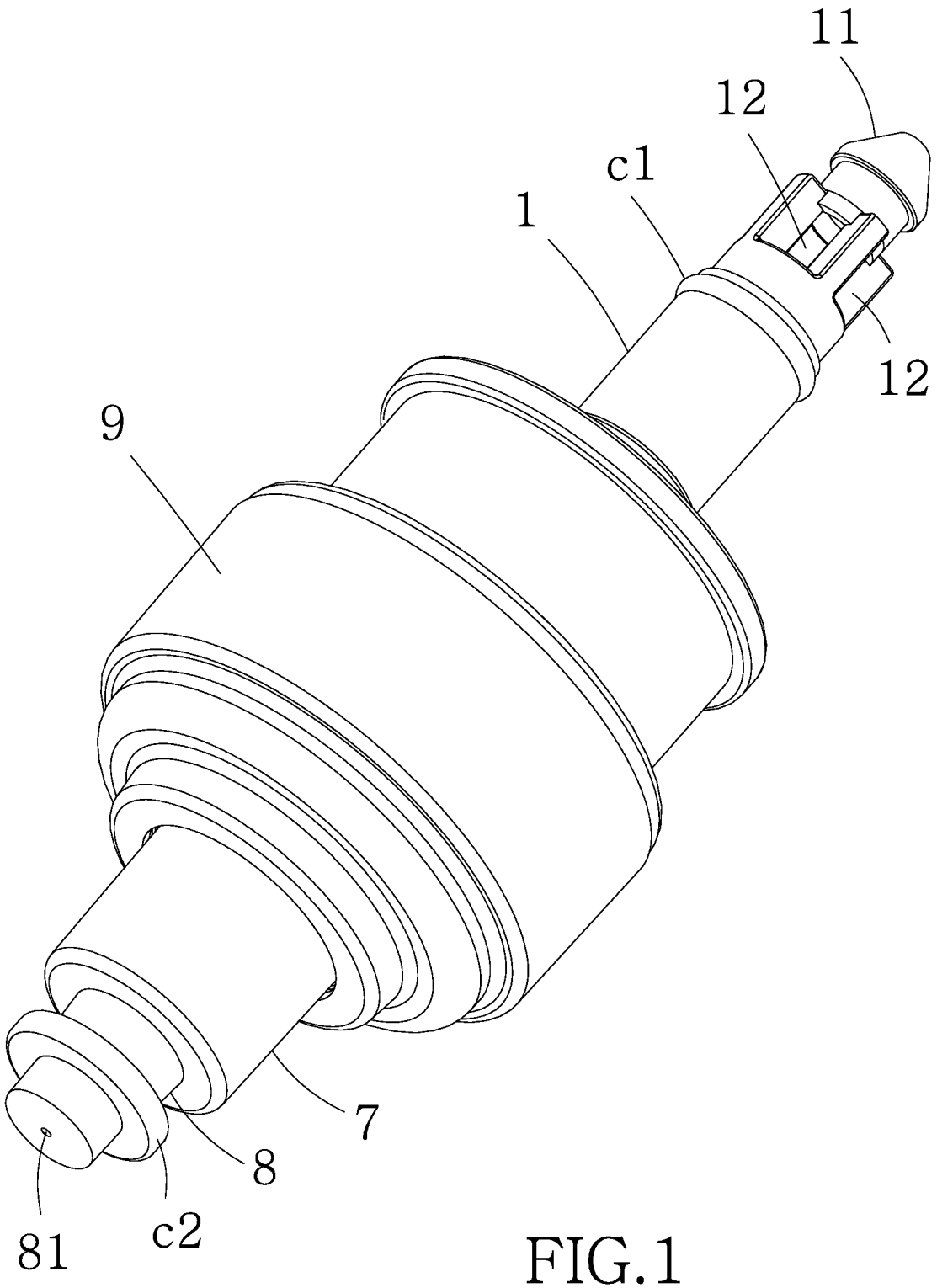
FIG. 1 is a perspective view of a lotion pump according to the invention.
Figure 2:
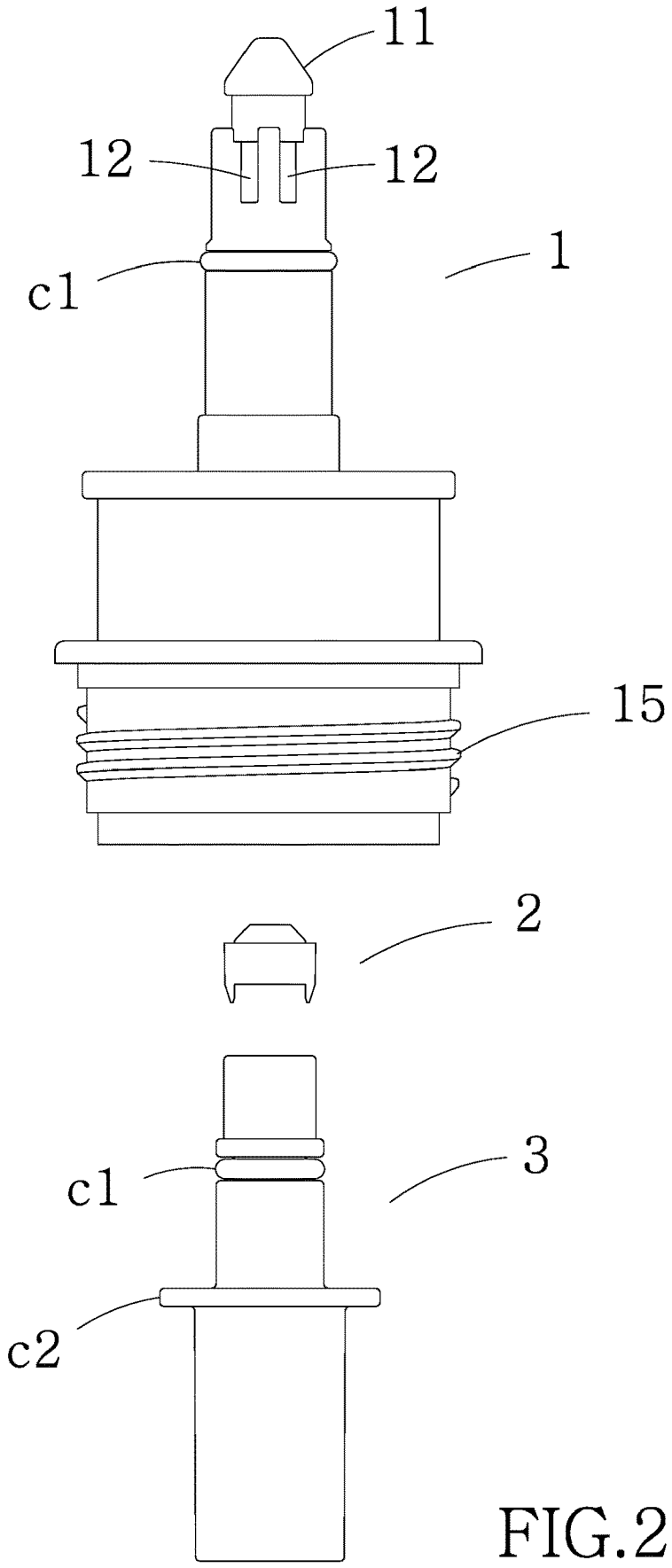
FIG. 2 is an exploded view of the first housing, the check valve and the dip tube.
Figure 3:
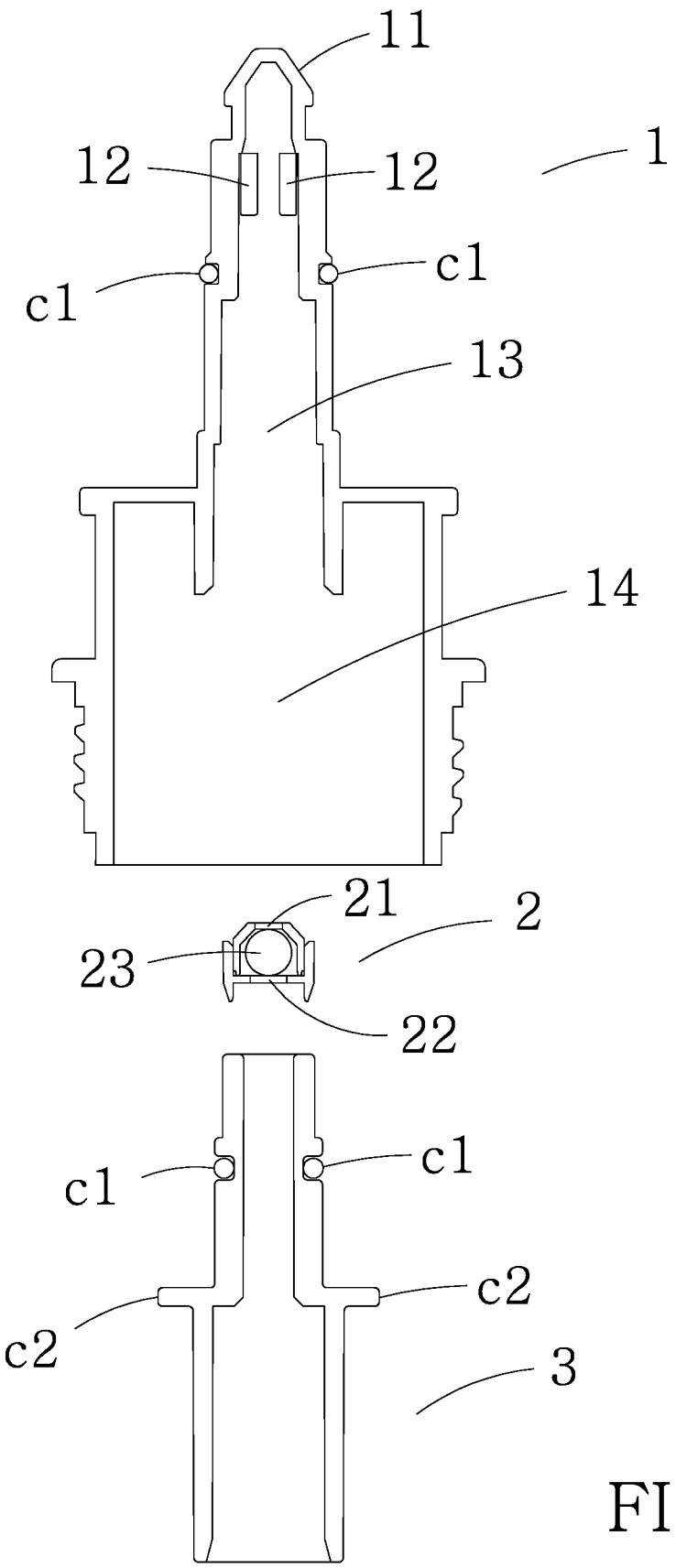
FIG. 3 is a longitudinal sectional view of the first housing, the check valve and the dip tube shown in FIG. 2.
Figure 4:
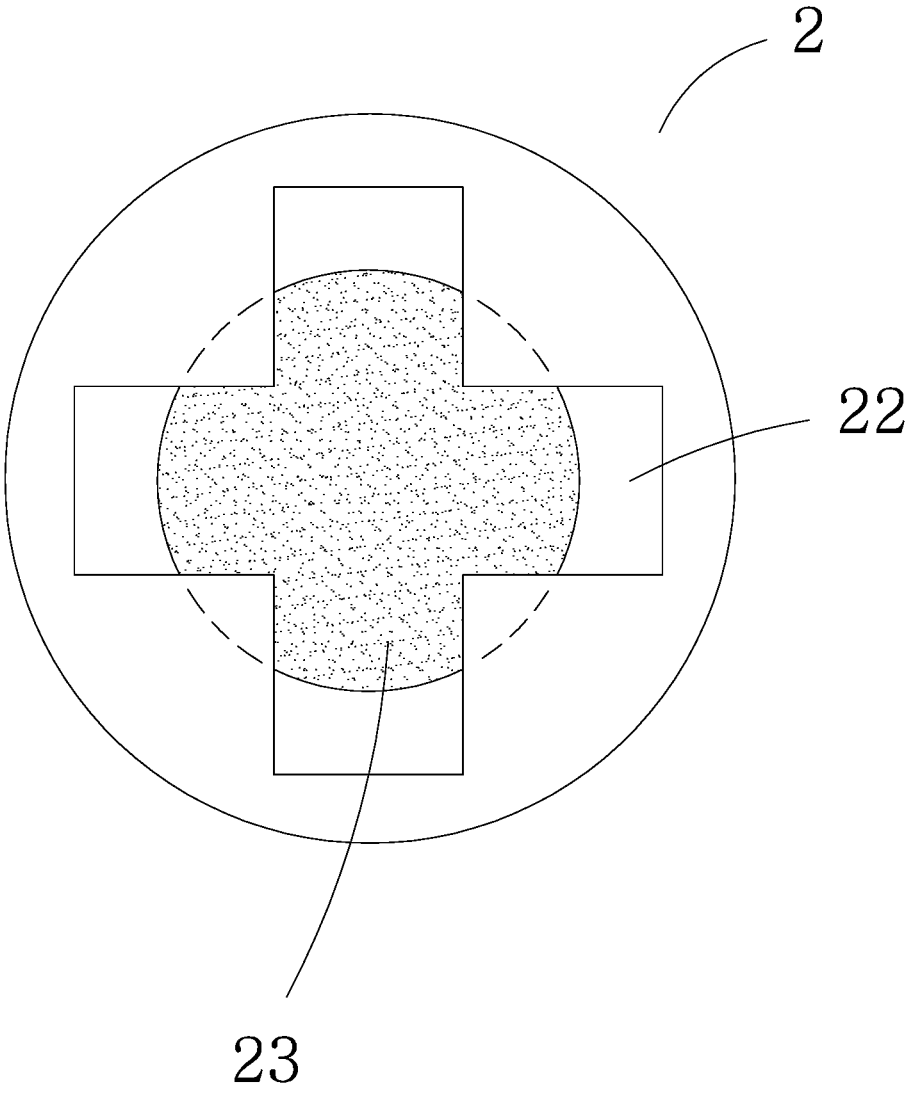
FIG. 4 is a bottom plan view of the check valve.
Figure 5:
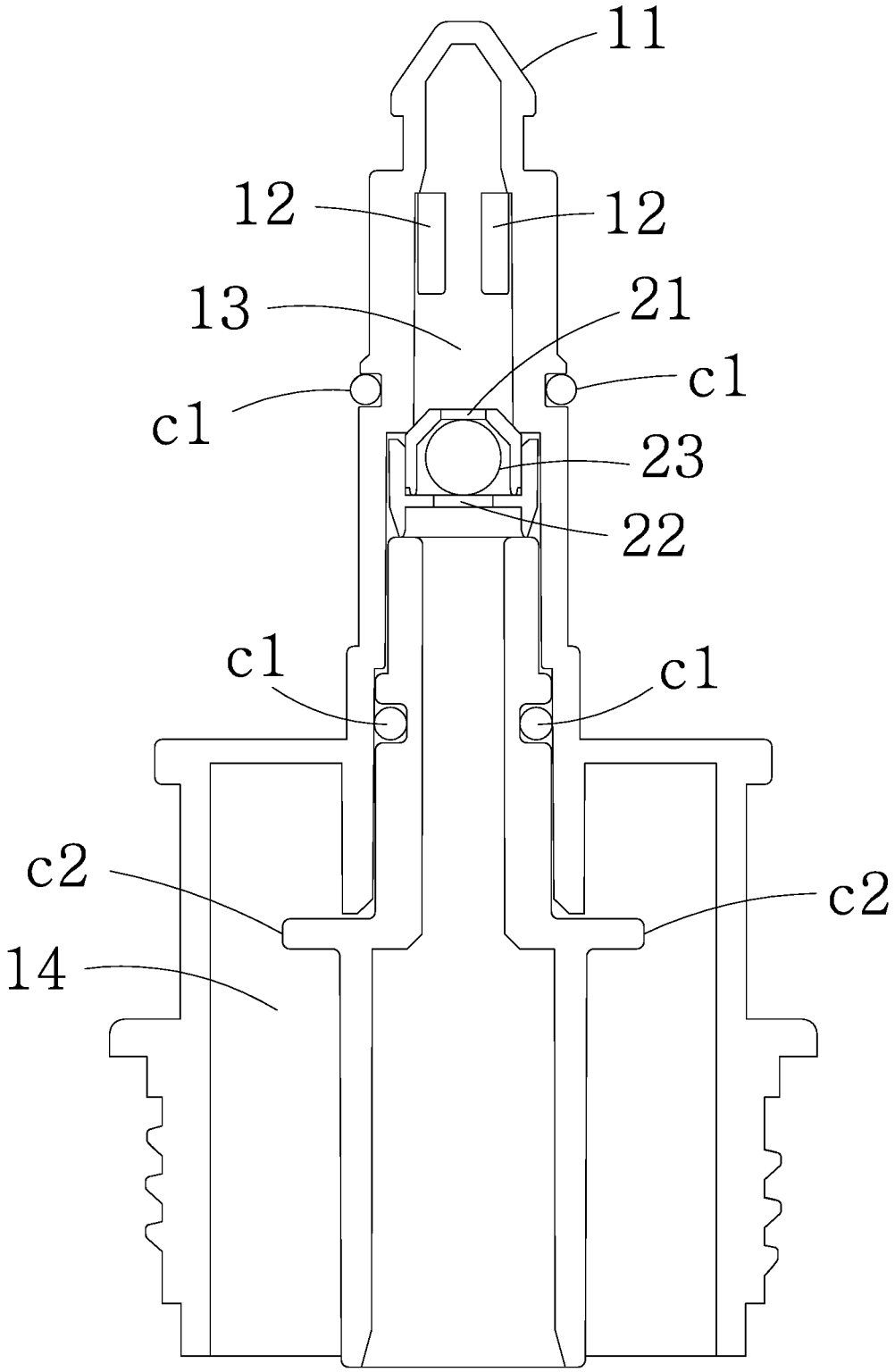
FIG. 5 is a longitudinal sectional view of the assembled first housing, the check valve and the dip tube shown in FIG. 3.
Figure 6:
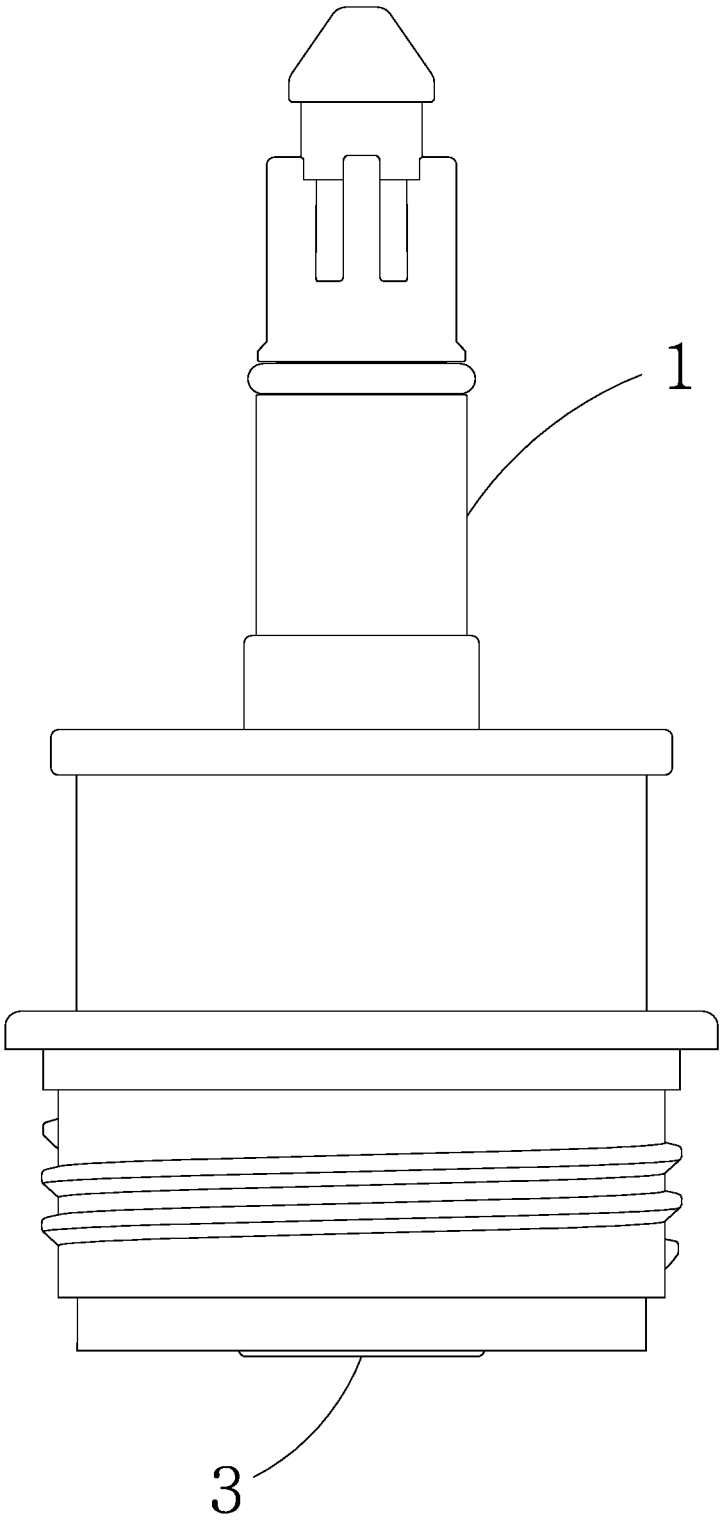
FIG. 6 is a side elevation of FIG. 5.
Figure 7:
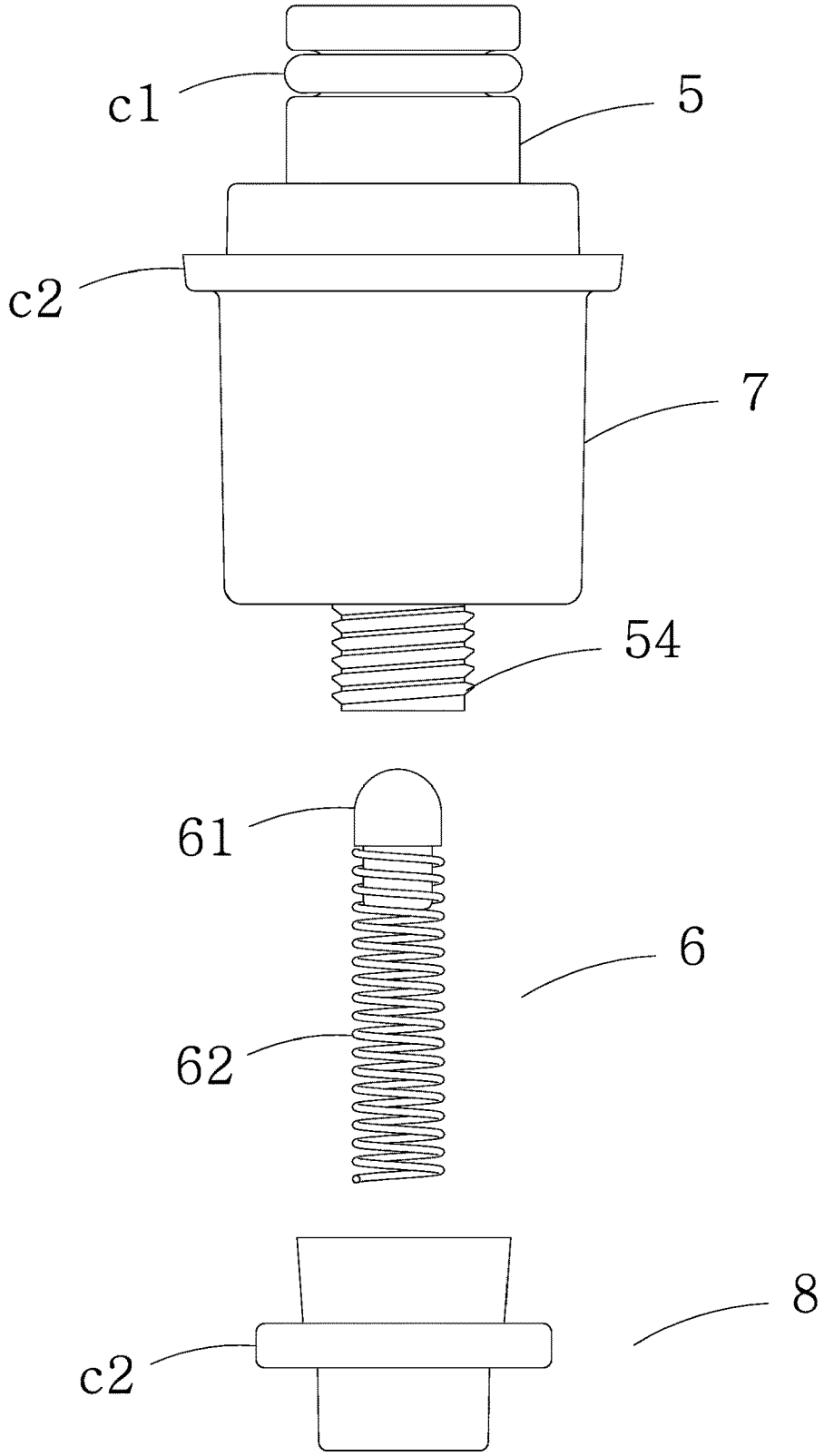
FIG. 7 is an exploded view of the support containing the second housing, the spring-loaded valve and the internally threaded cup.
Figure 8:
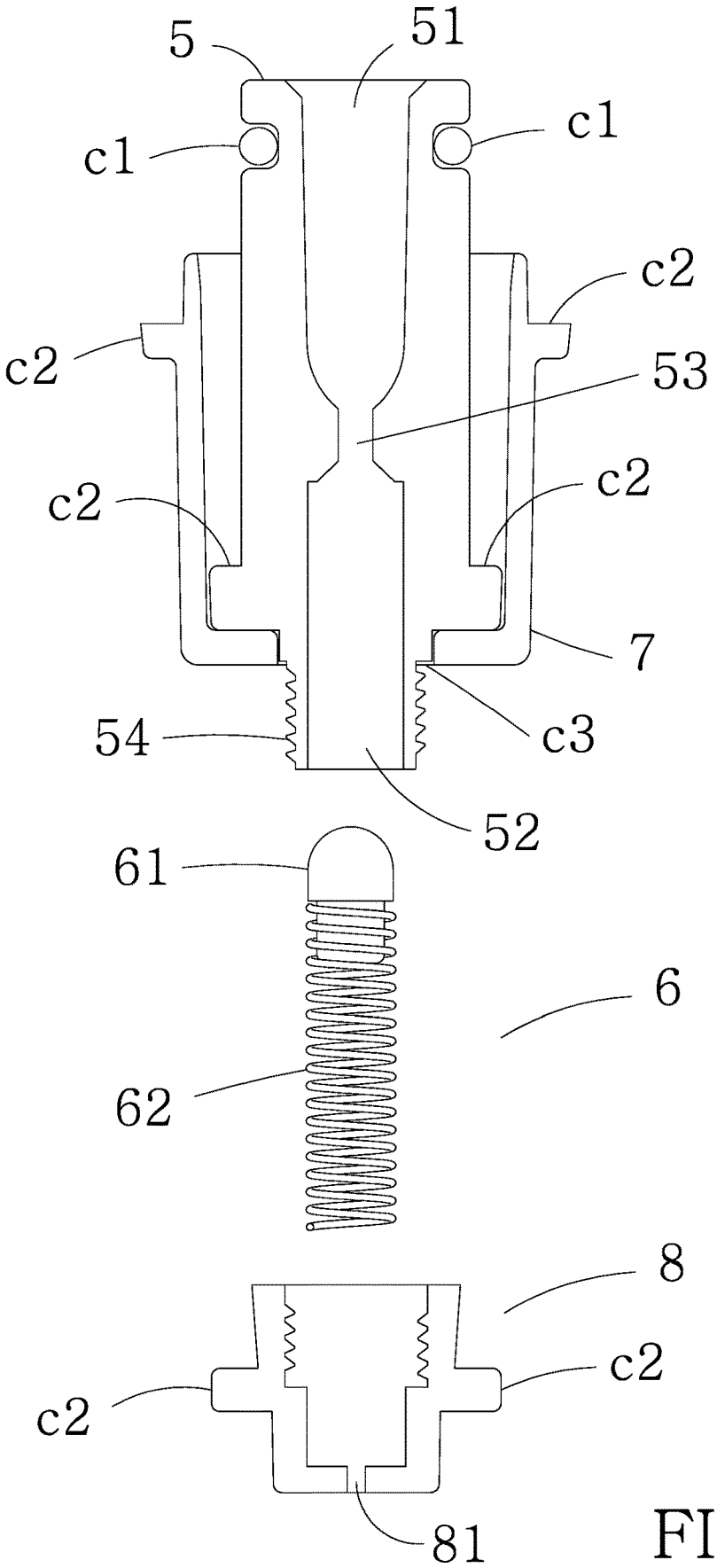
FIG. 8 is a view similar to FIG. 7 with the support, the second housing and the internally threaded cup shown in section.
Figure 9:
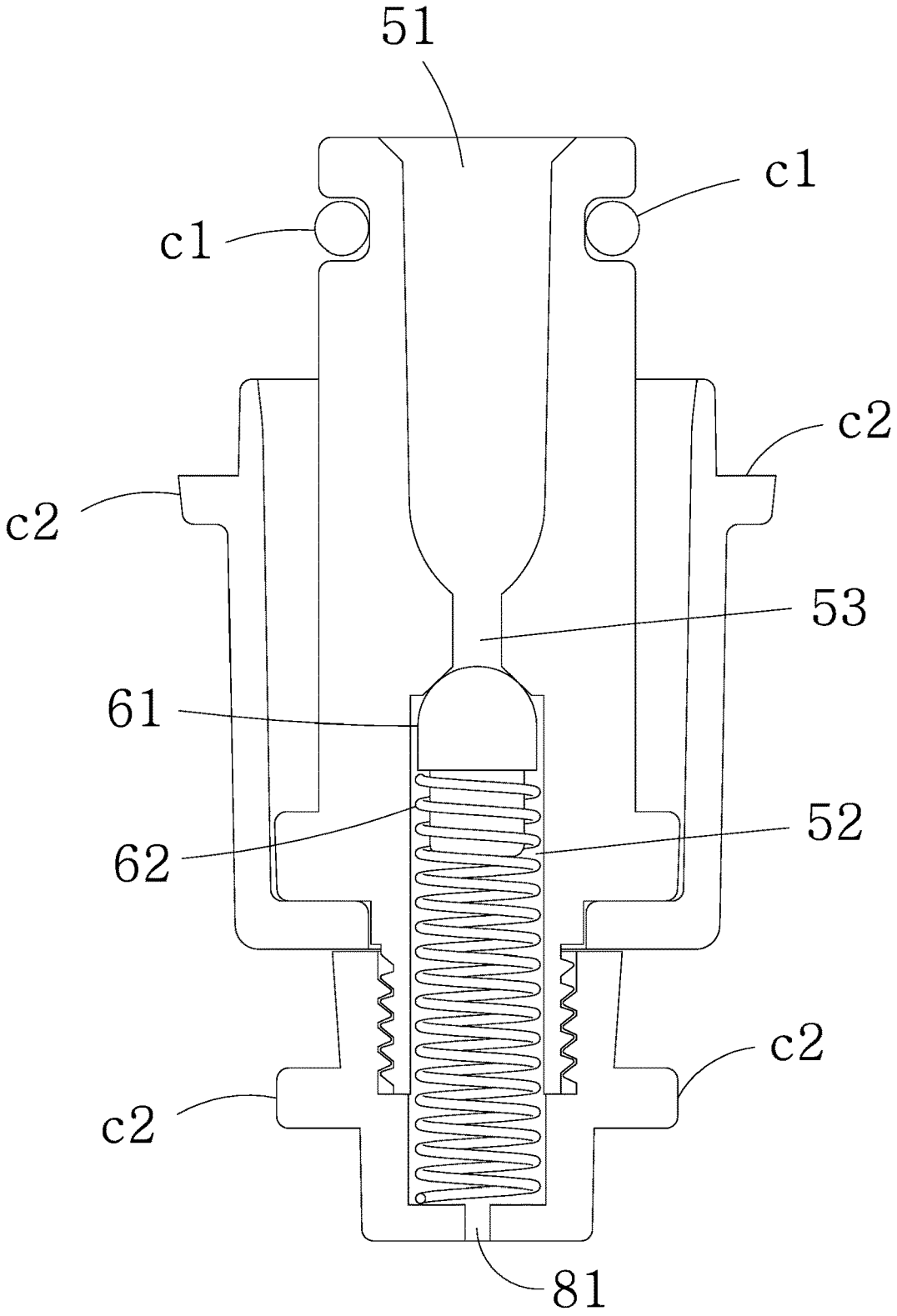
FIG. 9 is a view similar to FIG. 8 showing the assembled support, the second housing and the internally threaded cup.
Figure 10:
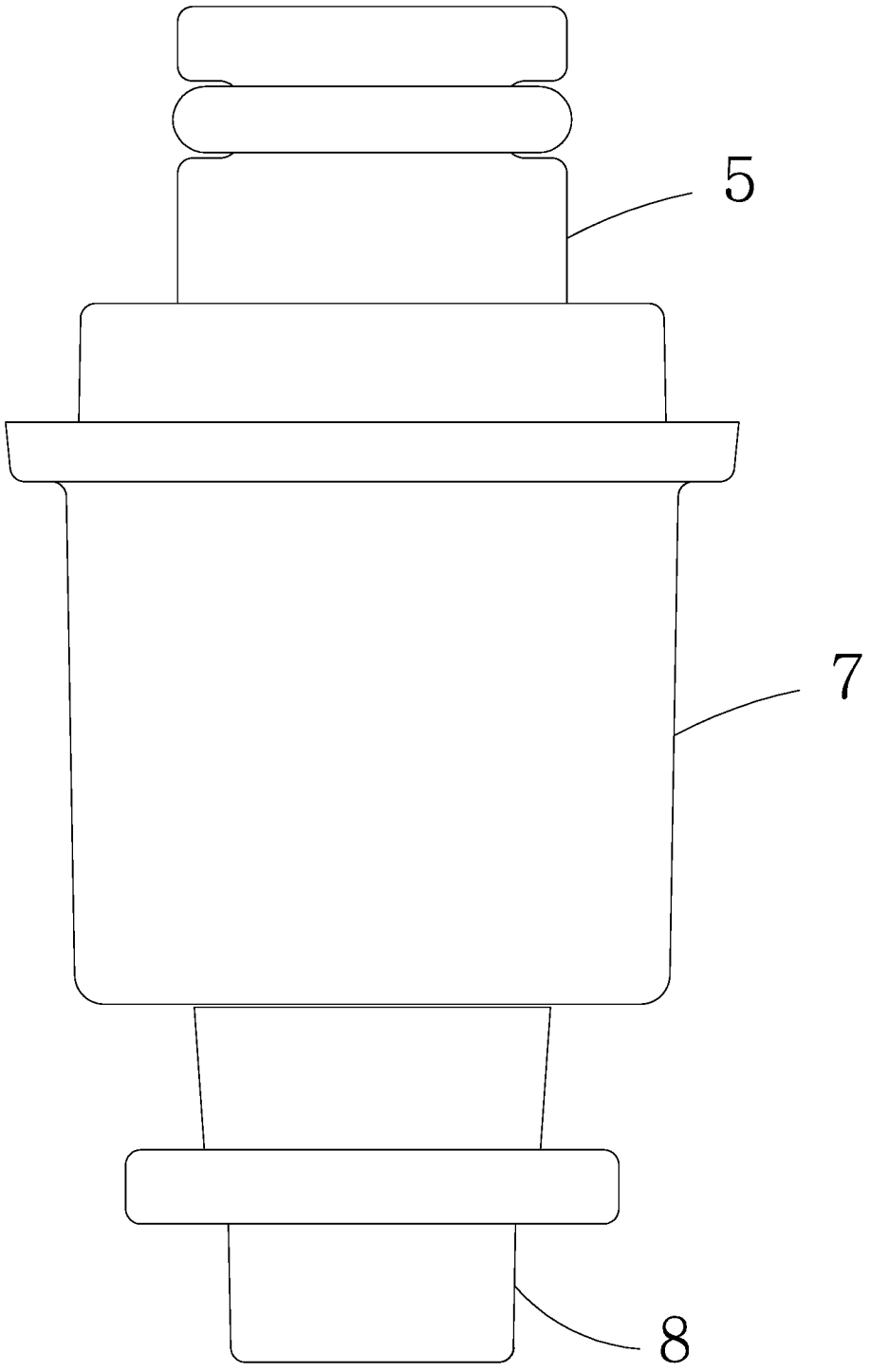
FIG. 10 is a side elevation of FIG. 9.
Figure 11:
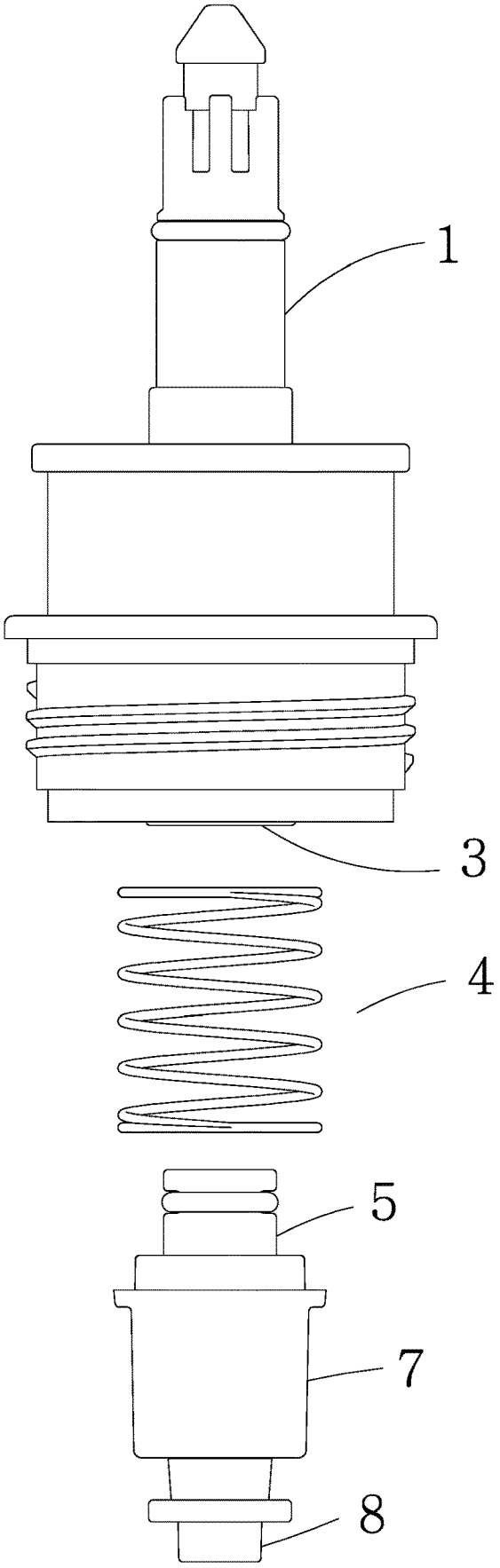
FIG. 11 is an exploded view of the first housing, the compression spring, and the support containing the second housing and the internally threaded cup.
Figure 12:
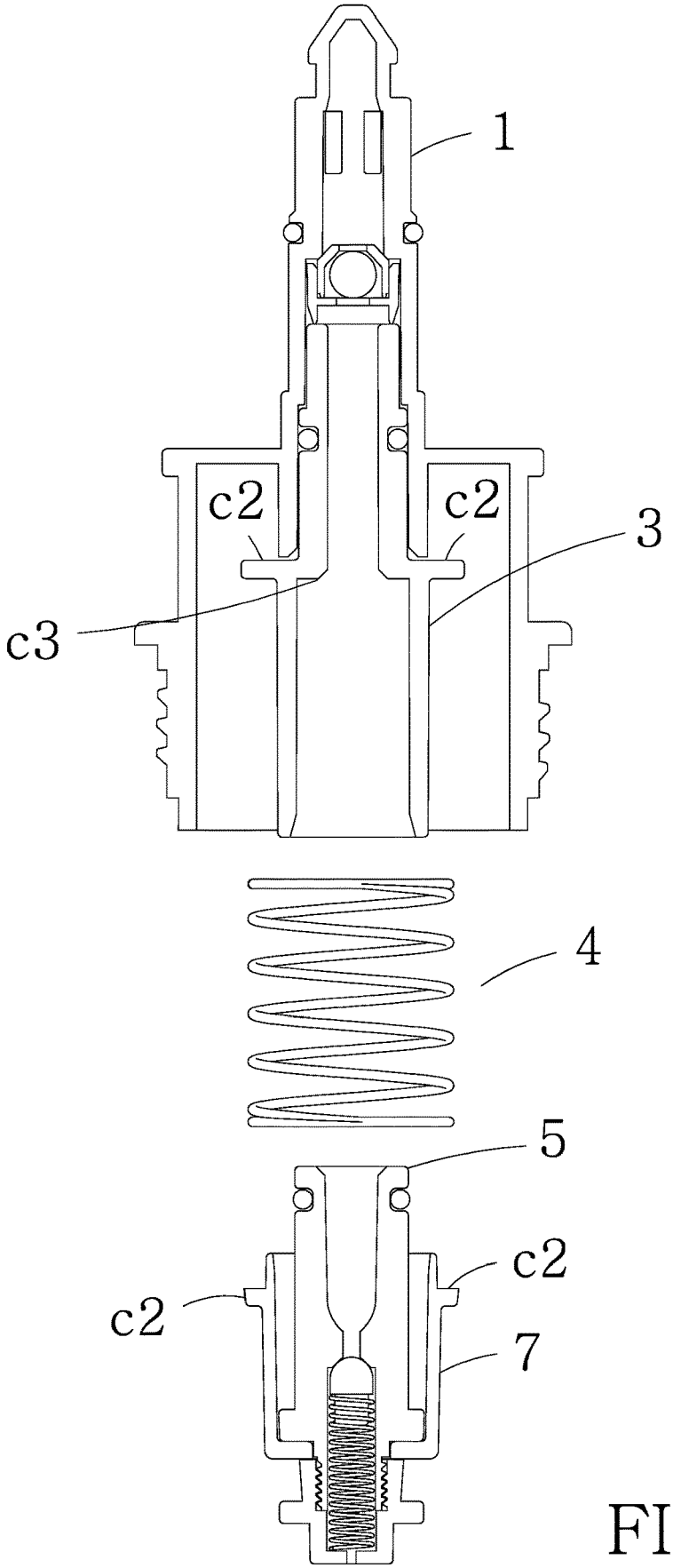
FIG. 12 is a view similar to FIG. 11 with the first housing, the dip tube, the support and the internally threaded cup shown in section.
Figure 13:
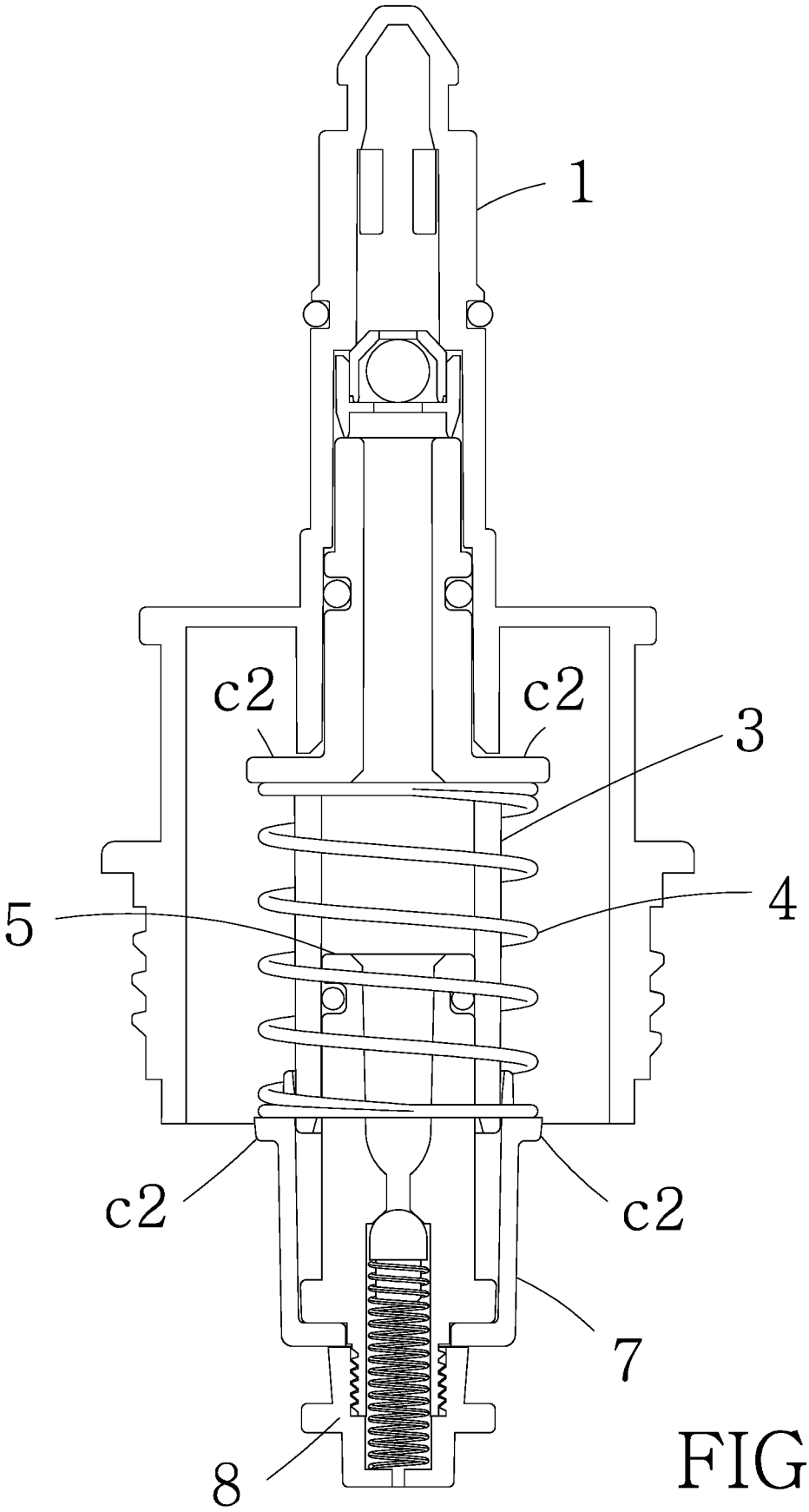
FIG. 13 is a view similar to FIG. 12 showing the assembled first housing, the dip tube, the support and the internally threaded cup.
Figure 14:
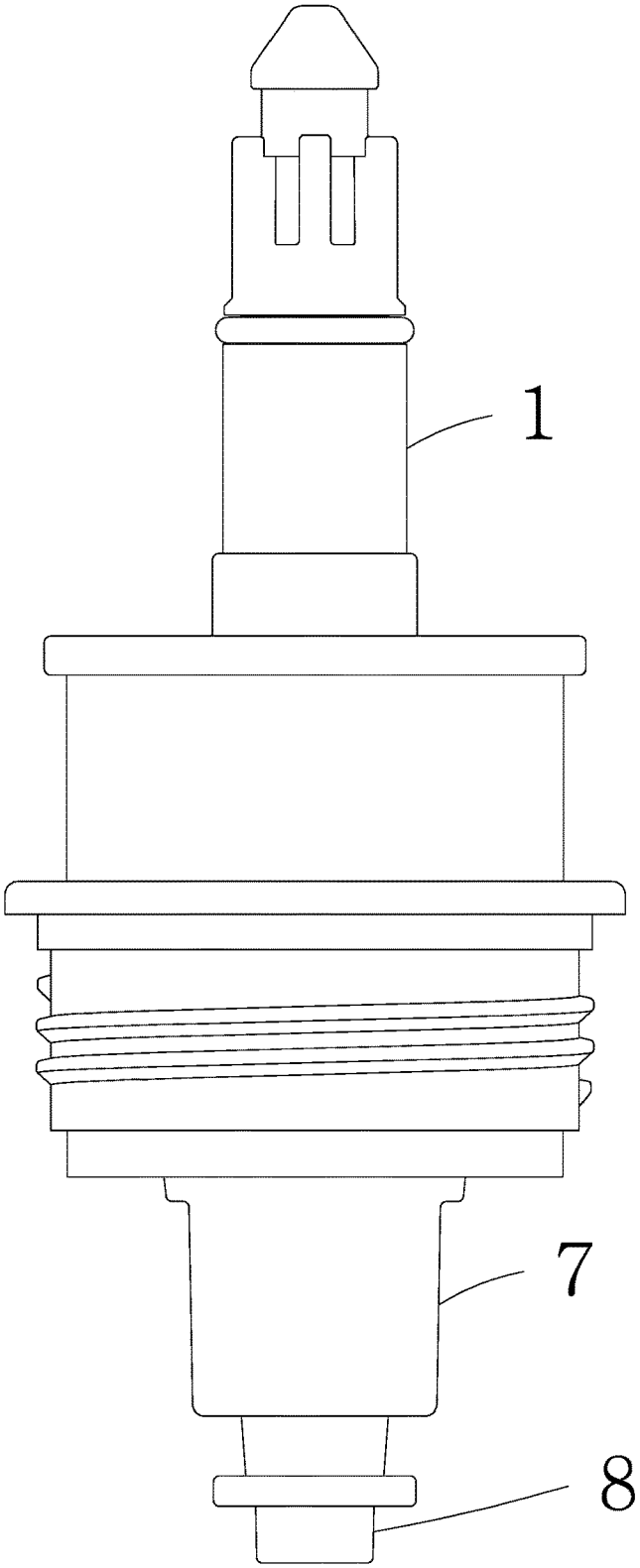
FIG. 14 is a side elevation of FIG. 13.
Figure 15:
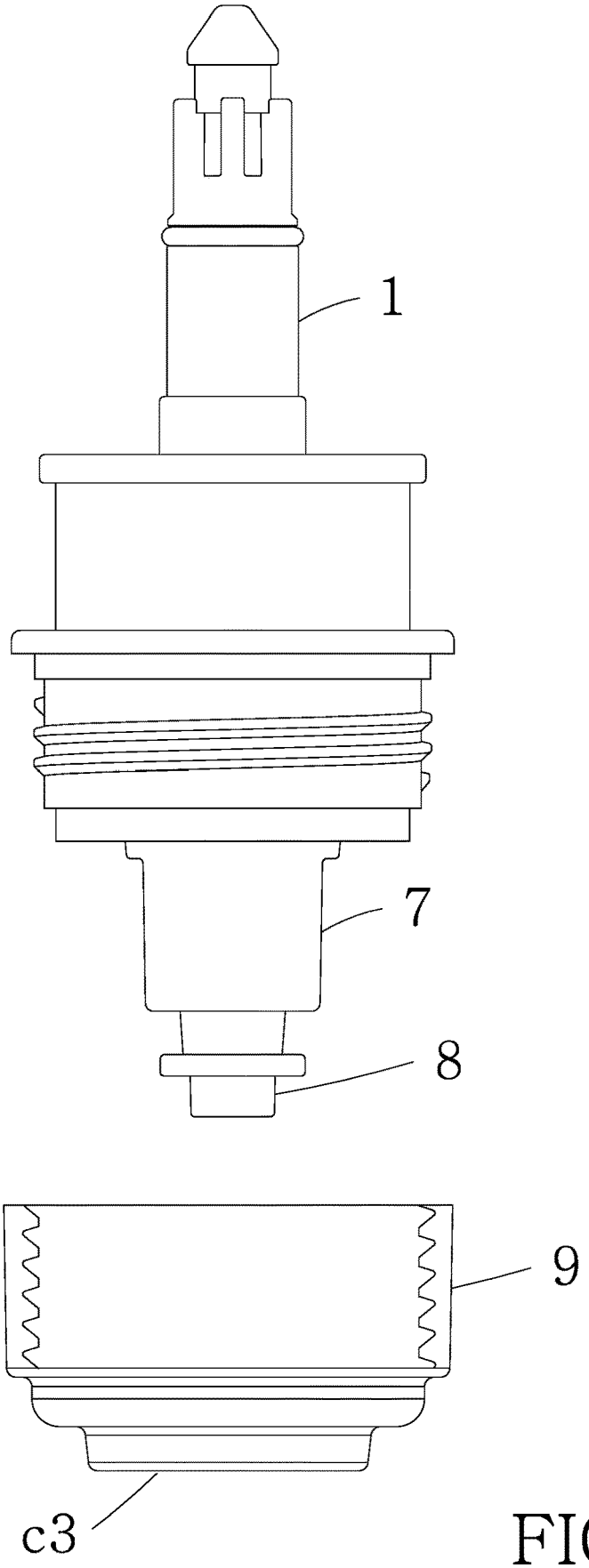
FIG. 15 is an exploded view showing the components of FIG. 14 and the internally threaded sleeve to be assembled.
Figure 16:
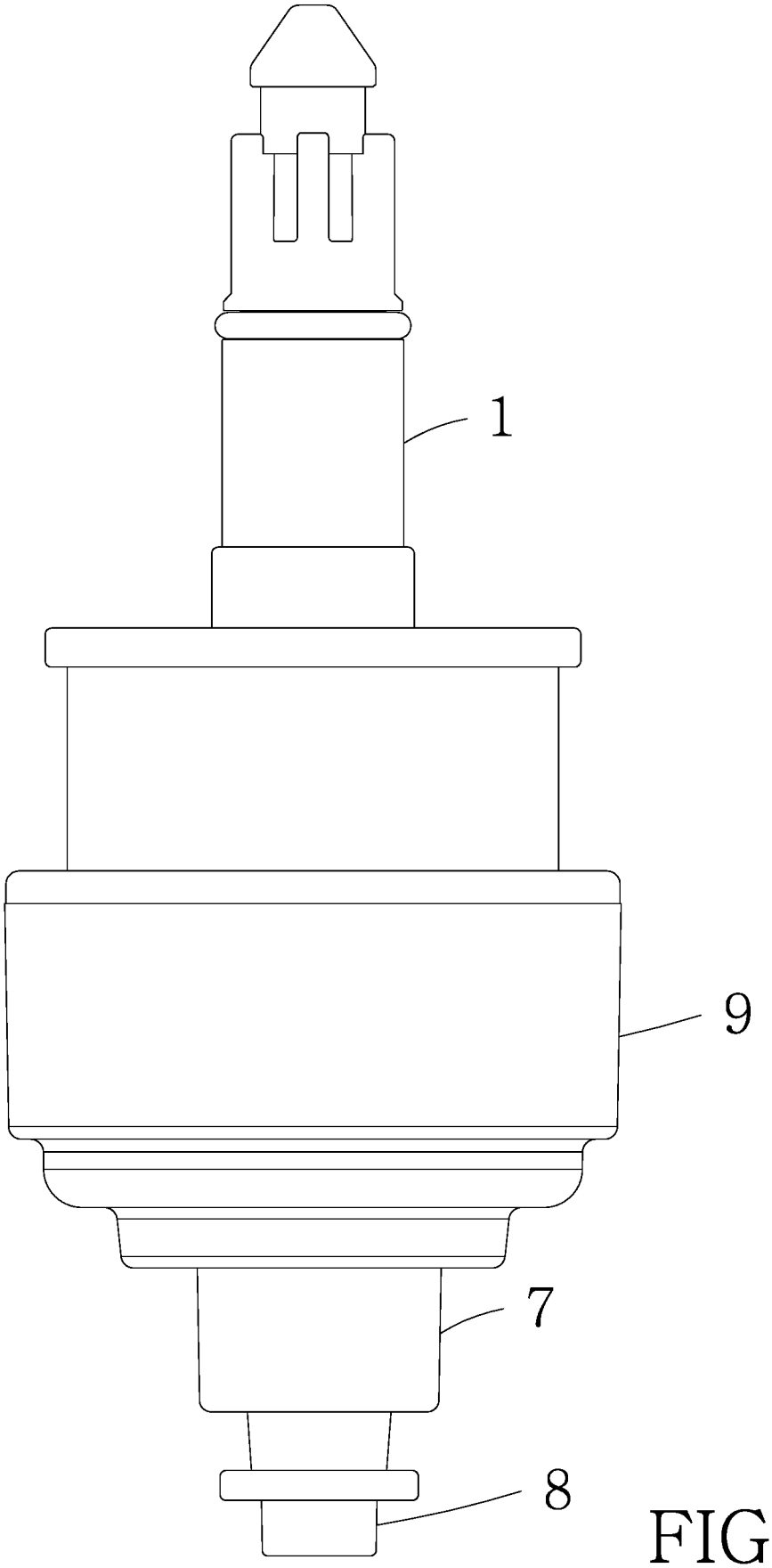
FIG. 16 is a side elevation of the assembled components shown in FIG. 15.
Figure 17:
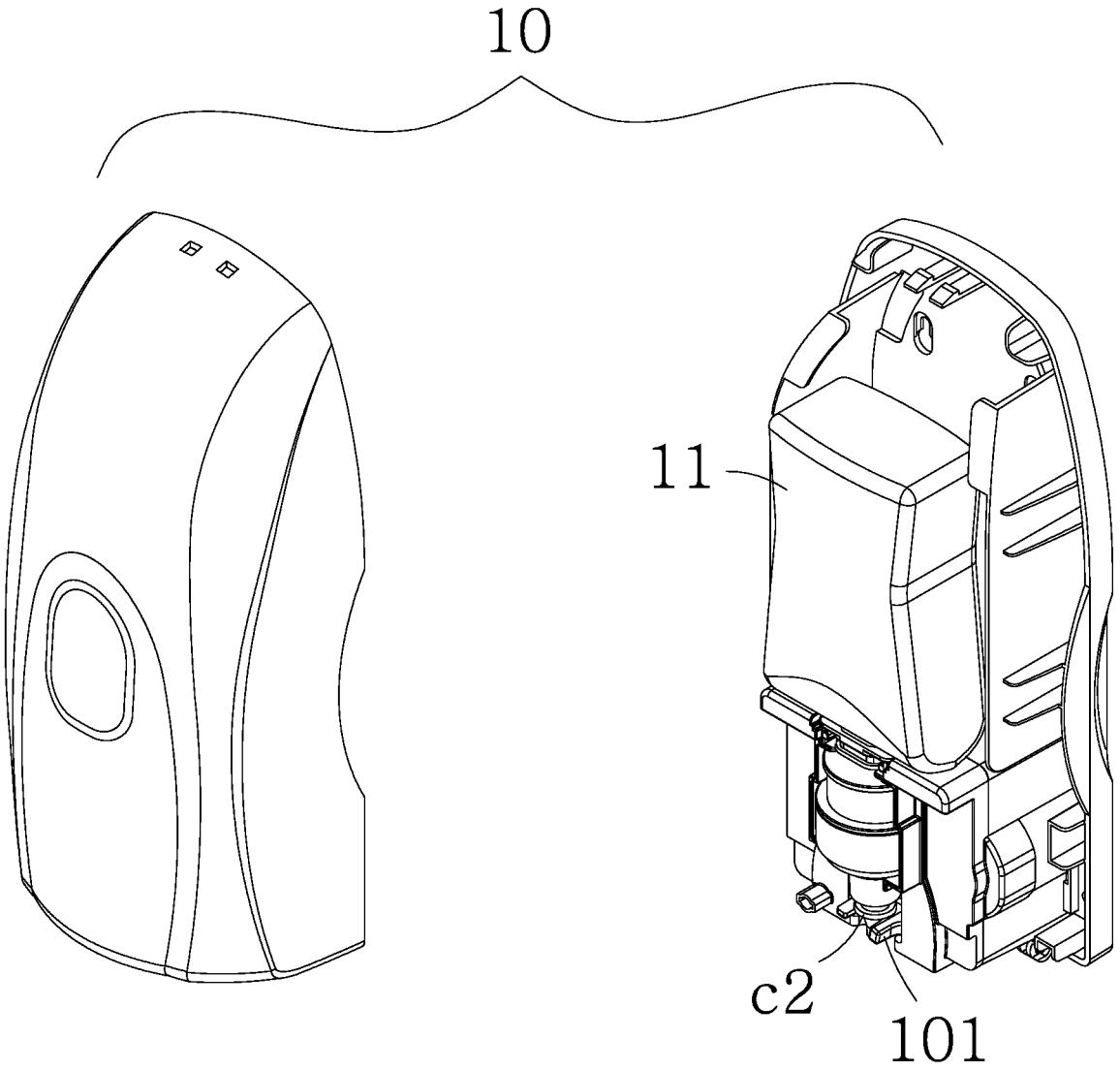
FIG. 17 is an exploded view of a fluid dispenser incorporating the lotion pump.
Figure 18:
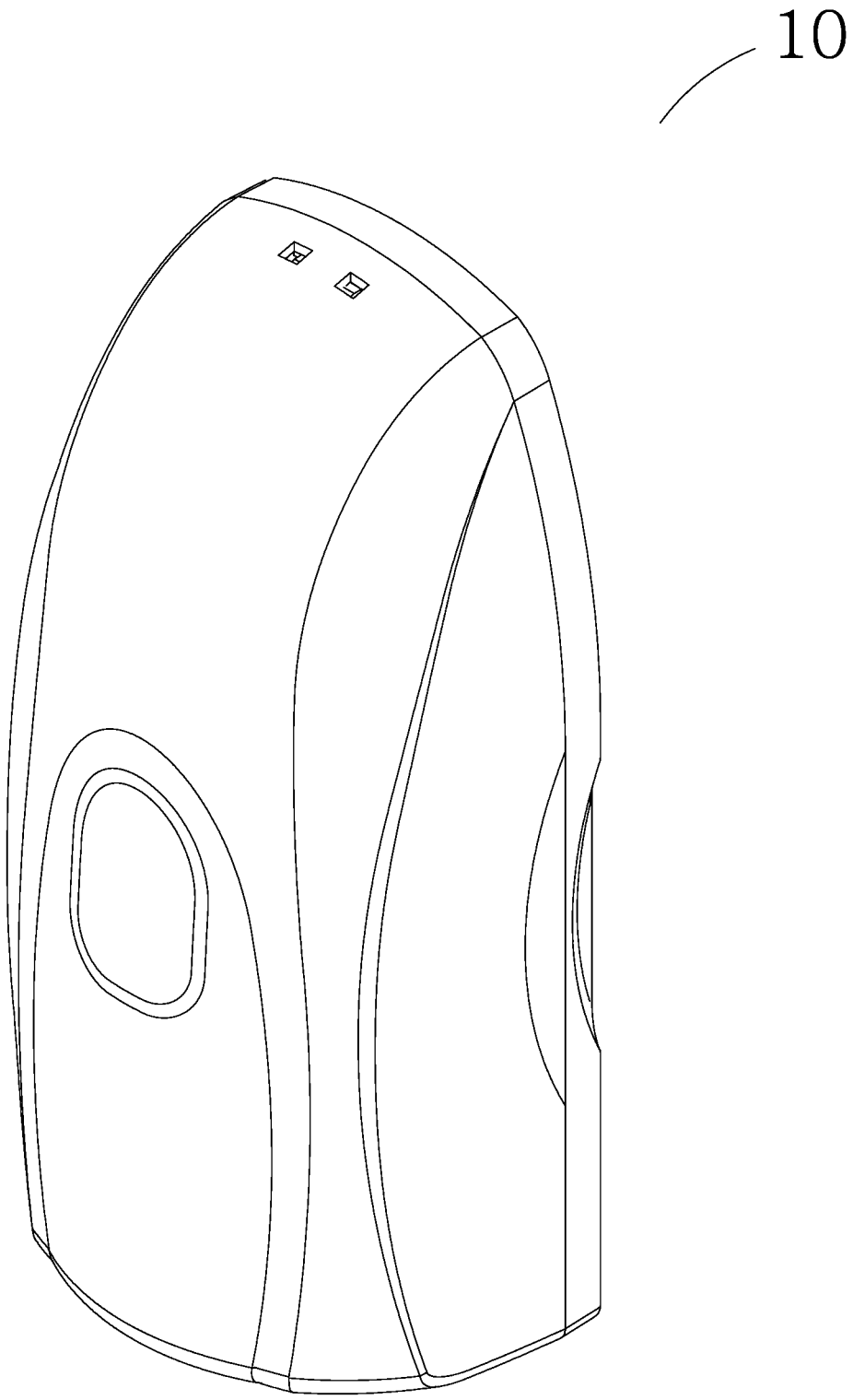
FIG. 18 is a perspective view of the assembled fluid dispenser.
Figure 19:
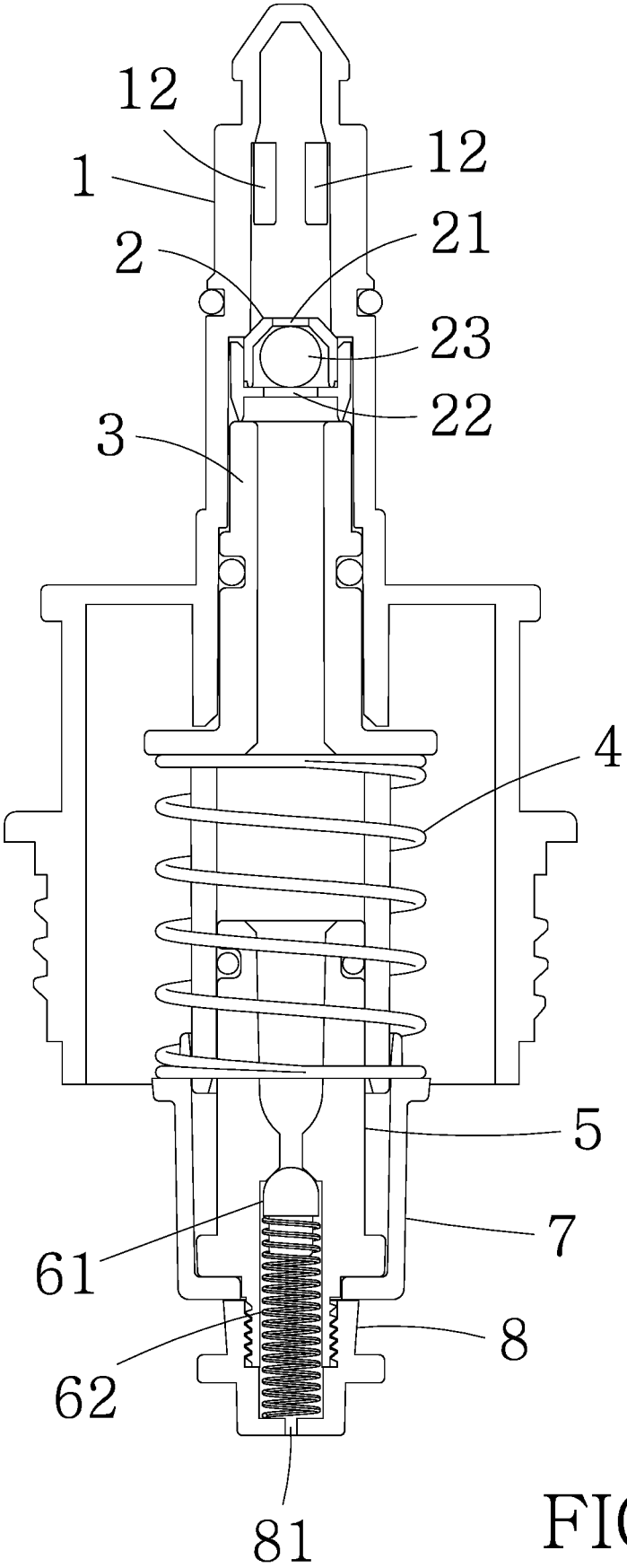
FIG. 19 is a longitudinal sectional view of the lotion pump when not in use.
Figure 20:
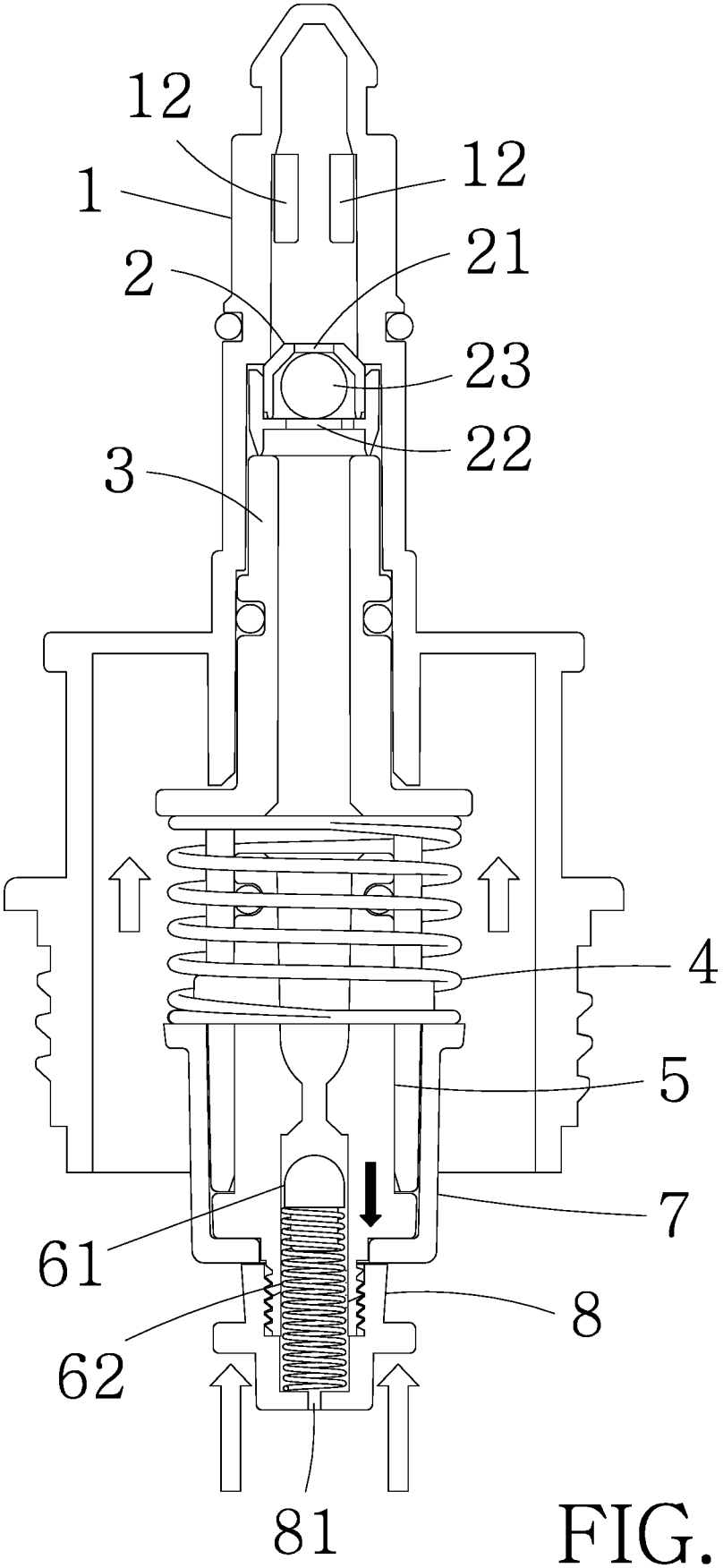
FIG. 20 is a view similar to FIG. 19 when the lotion pump when is in use.
Figure 21:
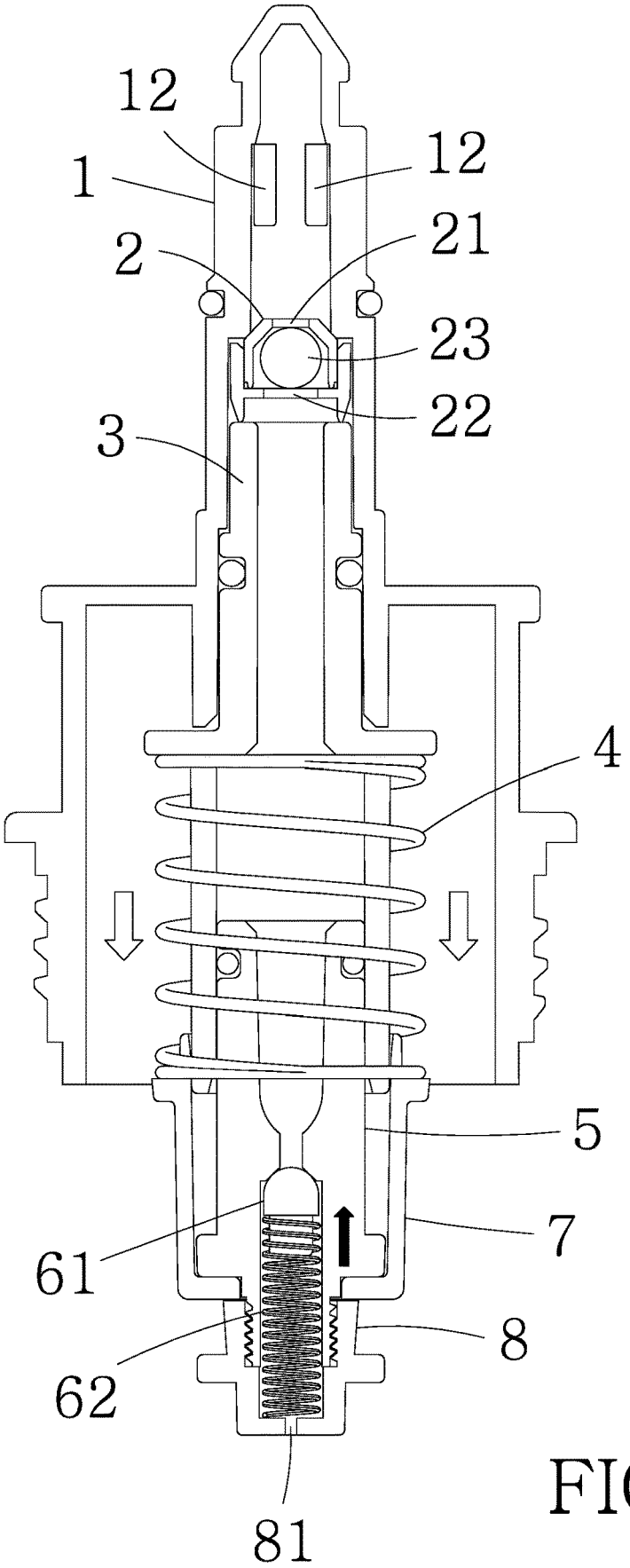
FIG. 21 is a view similar to FIG. 20 showing the lotion pump returning to the inoperative position of FIG. 19 from the operative position of FIG. 20.

Referring to FIGS. 1 to 21, a lotion pump in accordance with the invention comprises a first housing 1, a check valve 2, a dip tube 3, a compression spring 4, a second housing 5, a support 7, a spring-loaded valve 6, an internally threaded cup 8 and an internally threaded sleeve 9 as discussed in detail below.

The first housing 1 includes a tapered head 11, a chamber 14 spaced from the head 11, a tunnel 13 communicating between the head 11 and the chamber 14, an O-ring c1 on the tunnel 13 and spaced from the head 11, a plurality of spaced overflow openings 12 on the tunnel 13 and disposed between the head 11 and the O-ring c1, and external threads 15 on an outer surface of the chamber 14.

The check valve 2 includes an opening 21, a cross-shaped hole 22 spaced from the opening 21, and a ball 23 disposed between the opening 21 and the cross-shaped hole 22.

The dip tube 3 includes an annular flange c2 on an intermediate portion of an outer surface, an O-ring c1 on the outer surface and disposed between a first end and the flange c2, and an internal shoulder c3 being flush with the flange c2 thereof. The second housing 5 includes a first chamber member 51 open to a first end, a second chamber member 52 open to a second end, a channel 53 communicating between the first chamber member 51 and the second chamber member 52, external threads 54 on a projected portion of the second chamber member 52, an annular flange c2 on an outer surface adjacent to the external threads 54, and a first O-ring c1 on the outer surface adjacent to the first end;

The support 7 includes an annular flange c2 on an outer surface adjacent to a first end, and an opening c3 at a second end.

The spring-loaded valve 6 includes a plug 61 and a compression spring 62 partially put on the plug 61.

The internally threaded cup 8 has an open first end and includes an annular flange c2 on an intermediate portion of an outer surface, and a hole 81 through a second end.

The internally threaded sleeve 9 includes an opening c3 through a second end.

The check valve 2 is mounted in the tunnel 13. The dip tube 3 is also mounted in the tunnel 13. A first end of the tunnel 13 urges against the second end of the check valve 2. The flange c2 of the dip tube 3 urges against the tunnel 13. The second housing 5 is mounted in the support 7, the flange c2 of the second housing 5 urges against an inner surface of the second end of the support 7, and the external threads 54 of the second housing 5 pass through the opening c3 of the support 7 to threadedly fasten in the internally threaded cup 8. The spring-loaded valve 6 is partially mounted in the second chamber member 52 with the plug 61 urged against the channel 53 due to the expansion of the compression spring 62. An end of the compression spring 62 enters the internally threaded cup 8 to urge against the hole 81. The compression spring 4 is put on the dip tube 3 to have a first end urging against the flange c2 of the dip tube 3 and a second end urging against the flange c2 of the support 7. The first end of the second housing 5 urges against the shoulder c3 of the dip tube 3. The opening c3 of the internally threaded sleeve 9 passes through both the support 7 and the internally threaded cup 8 so that the internally threaded sleeve 9 may be threadedly secured to the external threads 15 of the first housing 1. The flange c2 of the support 7 is rested on an inner surface of the opening c3 of the internally threaded sleeve 9.

The lotion pump is mounted in a fluid dispenser 10. A container 11 containing soap of the fluid dispenser 10 is mounted on the first housing 1. The flange c2 of the internally threaded cup 8 is rested on an actuator 101 of the fluid dispenser 10.

When the lotion pump is not in use, the soap in the container 11 flows to the tunnel 13 through the overflow openings 12. And in turn, the soap flows to the dip tube 3 through the opening 21 and the cross-shaped hole 22. Further, the soap flows to the first chamber member 51 and the channel 53 for storage because the passage from the channel 53 to the second chamber member 52 is blocked by the plug 61. Thus, the soap is prevented from flowing to the hole 81.

Using of the lotion pump is discussed below. In response to sensing the approaching of the hand by a sensor (not shown) of the fluid dispenser 10, the actuator 101 applies an upward force to push the flange c2 of the internally threaded cup 8 upward. And in turn, both the support 7 and the second housing 5 move upward to compress the compression spring 4. And in turn, the ball 23 is pushed to block the opening 21 by the pressurized soap. And in turn, the plug 61 is pushed downward by the pressurized soap to compress the compression spring 62 with the channel 53 being open. As a result, the soap flows out of the hole 81 onto the hand. Further, pressure exerted by the soap decreases as the flow continues. And in turn, both the compression spring 4 and the compression spring 62 expand to return to their original positions when the flow stops. Also, both the support 7 and the second housing 5 return to their original positions, the passage from the channel 53 to the second chamber member 52 is blocked by the plug 61 again, and the ball 23 moves to unblock the opening 21 all due to the expansion of the compression spring 4. As an end, the soap in the container 11 flows to the first chamber member 51 and the channel 53 for storage through the overflow openings 12, the tunnel 13, the opening 21, the cross-shaped hole 22, and the dip tube 3.

All of the O-rings c1 are used to prevent the soap from leaking.

While the invention has been described in terms of preferred embodiments, those skilled in the art will recognize that the invention can be practiced with modifications within the spirit and scope of the appended claims.

What is claimed is:

1. A lotion pump comprising:

an internally threaded sleeve;

a dip tube including an annular first flange on an outer surface, and an internal shoulder;

a biasing member put on the dip tube to have a first end urging against the first flange;

a first housing including a tapered head, a chamber spaced from the tapered head, a tunnel communicating between the tapered head and the chamber, a plurality of spaced overflow openings on the tunnel adjacent to the tapered head, and first external threads on an outer surface of the chamber;

a check valve including a first opening, a first hole spaced from the first opening, and a ball disposed between the first opening and the first hole;

a second housing including a first chamber member open to a first end, a second chamber member open to a second end, a channel communicating between the first chamber member and the second chamber member, second external threads on a projected portion of the second chamber member, and an annular second flange on an outer surface adjacent to the second external threads;

a support including an annular third flange on an outer surface adjacent to a first end, and an second opening at a second end;

a spring-loaded valve including a plug; and an internally threaded cup having an open first end and including an annular fourth flange on an outer surface, and a second hole through a second end;

wherein the check valve is disposed in the tunnel, the dip tube is disposed in the tunnel of the first housing, a first end of the tunnel urges against a second end of the check valve, the first flange of the dip tube urges against the tunnel, the second housing is disposed in the support, the second flange of the second housing urges against an inner surface of the second end of the support, the second external threads of the second housing pass through the second opening of the support to threadedly fasten in the internally threaded cup, the spring-loaded valve is partially disposed in the second chamber member of the second housing with the plug of the spring-loaded valve urging against the channel of the second housing, an end of the spring-loaded valve enters the internally threaded cup to urge against the second hole of the internally threaded cup, a second end of the biasing member urges against the third flange of the support, the first end of the second housing urges against the internal shoulder of the dip tube, the internally threaded sleeve is threadedly secured to the first external threads of the first housing, and the third flange of the support is fastened in the internally threaded sleeve.

* * * * *